US007404263B2

(12) United States Patent
Guzman

(10) Patent No.: US 7,404,263 B2
(45) Date of Patent: Jul. 29, 2008

(54) FOOTWEAR WITH FORCE SENSING DEVICE

(75) Inventor: Rudy Guzman, Coral Springs, FL (US)

(73) Assignee: BBC International, LLC, Boca Raton, FL (US)

( * ) Notice: Subject to any disclaimer, the term of this patent is extended or adjusted under 35 U.S.C. 154(b) by 334 days.

(21) Appl. No.: 11/329,940

(22) Filed: Jan. 11, 2006

(65) Prior Publication Data

US 2007/0157488 A1 Jul. 12, 2007

(51) Int. Cl.
*A43B 5/02* (2006.01)

(52) U.S. Cl. ..... 36/133; 36/132; 36/137; 36/128

(58) Field of Classification Search ..... 36/133, 36/132, 137, 128
See application file for complete search history.

(56) References Cited

U.S. PATENT DOCUMENTS 4,204,346 A 5/1980 Fugere
4,711,043 A 12/1987 Johnson et al.
4,814,661 A * 3/1989 Ratzlaff et al. ..... 36/136
5,067,259 A 11/1991 Fruge
5,216,827 A 6/1993 Cohen
5,437,289 A 8/1995 Liverance et al.
5,471,405 A * 11/1995 Marsh ..... 36/114
5,483,759 A 1/1996 Silverman
5,566,479 A * 10/1996 Gray et al. ..... 36/137
5,737,858 A 4/1998 Levy
5,782,727 A 7/1998 Pierce
5,897,446 A 4/1999 Wiseman et al.
6,807,869 B2 * 10/2004 Farringdon et al. .... 73/862.046
6,808,462 B2 * 10/2004 Snyder et al. ..... 36/132

FOREIGN PATENT DOCUMENTS

FR 2846524 A1 5/2004
WO 03/000355 A1 1/2003

* cited by examiner

*Primary Examiner*—Ted Kavanaugh
(74) *Attorney, Agent, or Firm*—GrayRobinson, P.A.

(57) ABSTRACT

An article of footwear is provided, particularly a soccer shoe, having one or more sensors mounted in the shoe upper which, when impacted by a ball, are effective to send a signal to a controller representative of the magnitude of the force with which the ball was struck by the shoe. A liquid crystal display, mounted within a housing which also carries the controller, provides a visual indication of the force of the ball strike which can be readily observed by the wearer of the shoe.

13 Claims, 4 Drawing Sheets

FOOTWEAR WITH FORCE SENSING DEVICE

FIELD OF THE INVENTION

This invention relates to articles of footwear, and, more particularly, to a shoe for use in activities such as soccer having at least one force sensor which is capable of sensing the impact of a ball with the shoe and providing a visual indication of the magnitude of the force with which the ball has been kicked.

BACKGROUND OF THE INVENTION

Articles of footwear have been provided with a wide variety of functional and aesthetic features ranging from decorative arrays of light sources such as light emitting diodes (LEDs) to air bladders located within the outsole of the shoe for enhanced comfort when performing activities such as running. Many improvements to footwear have been sports-specific and intended to assist the wearer with one or more aspects of his or her performance, or to assist in training for a particular sport.

Footwear intended for playing soccer is no exception. A number of designs to assist players in their training exercises have been proposed. For example, U.S. Pat. No. 4,204,346 to Fugers, U.S. Pat. No. 5,216,827 to Cohen and U.S. Pat. No. 5,897,446 to Wiseman et al disclose soccer shoes with different colored areas on the upper to aid the wearer in identifying and focusing on the desired location where he or she strikes the ball with the foot. U.S. Pat. No. 4,711,043 to Johnson et al teaches an attachment for a shoe which emits sound when the ball strikes it at desired location, but is silent if the ball strike is elsewhere.

Pressure sensors have also been incorporated into soccer shoes and other footwear such as disclosed in U.S. Pat. No. 6,808,462 to Snyder et al. In this invention, one or more pressure sensors are mounted on the upper of the shoe at locations where it is desired to make contact with the ball. When one of these sensors is activated as a result of a ball strike, an electrical signal is sent to a microprocessor which then causes a loudspeaker to produce a particular sound, e.g. "Way to Go" or the like.

SUMMARY OF THE INVENTION

This invention is directed to an article of footwear, particularly a soccer shoe, having one or more sensors mounted in the shoe upper which, when impacted by a ball, are effective to send a signal to a controller representative of the magnitude of the force with which the ball was struck by the shoe. A liquid crystal display (LCD), mounted within a housing which also carries the controller, provides a visual indication of the force of the ball strike which can be readily observed by the wearer of the shoe.

Each sensor includes a contact movable into engagement with a printed circuit in response to a ball strike. The extent of the force with which the sensors are impacted by the ball affects the duration or amount of time the contact remains in engagement with the printed circuit. In turn, the signal produced as a result of such engagement, or "timing signal," is representative of the magnitude of the force. The longer the duration of the timing signal, the greater the force of the ball strike against the contact. The controller is effective to convert the timing signal into a corresponding visual indication of the magnitude of the force applied to the sensor(s), which is then displayed on the LCD.

In one preferred embodiment, the controller is operative to cause the LCD to display the magnitude of the force of the last kick by the user when it is powered up. The controller stores in memory the previous kick of greatest force, and compares that value with the force of each successive kick. If a new kick has a greater magnitude than the previous kick of highest magnitude, then the new kick is displayed as the "high score" or hardest kick. Additionally, the controller is operative to record the number of kicks of the ball in a particular training session and cause the LCD to display that amount on a running basis or at the end of the session.

DESCRIPTION OF THE DRAWINGS

The structure, operation and advantages of the presently preferred embodiment of this invention will become further apparent upon consideration of the following description, taken in conjunction with the accompanying drawings, wherein.

DETAILED DESCRIPTION OF THE INVENTION

Figure 1:
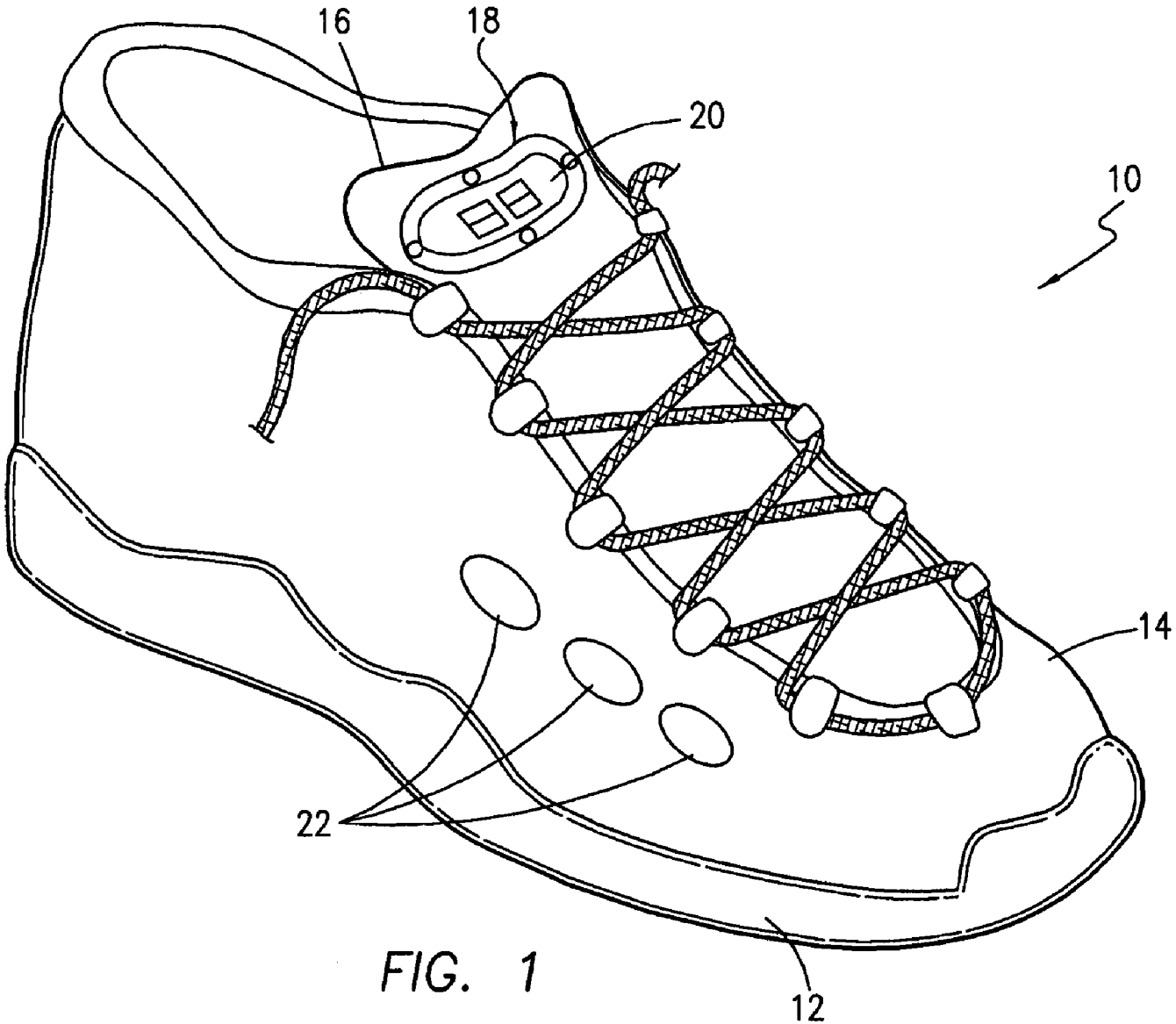
FIG. 1 is a perspective view of a shoe with a housing having an LCD display, and a number of force sensors mounted to the shoe upper.

Referring now to the drawings, a shoe 10 is shown in FIG. 1 having an outsole 12 connected to an upper 14 including a tongue 16. In the presently preferred embodiment, a housing 18 having an LCD display 20 is mounted to the tongue 16 and coupled to one or more pressure sensors 22 located at selected positions on the upper 14. It should be understood that the housing 18 and pressure sensors 22 could be mounted elsewhere on the shoe 10, as desired, and the locations depicted in FIG. 1 are for purposes of illustration only.

Figure 2:
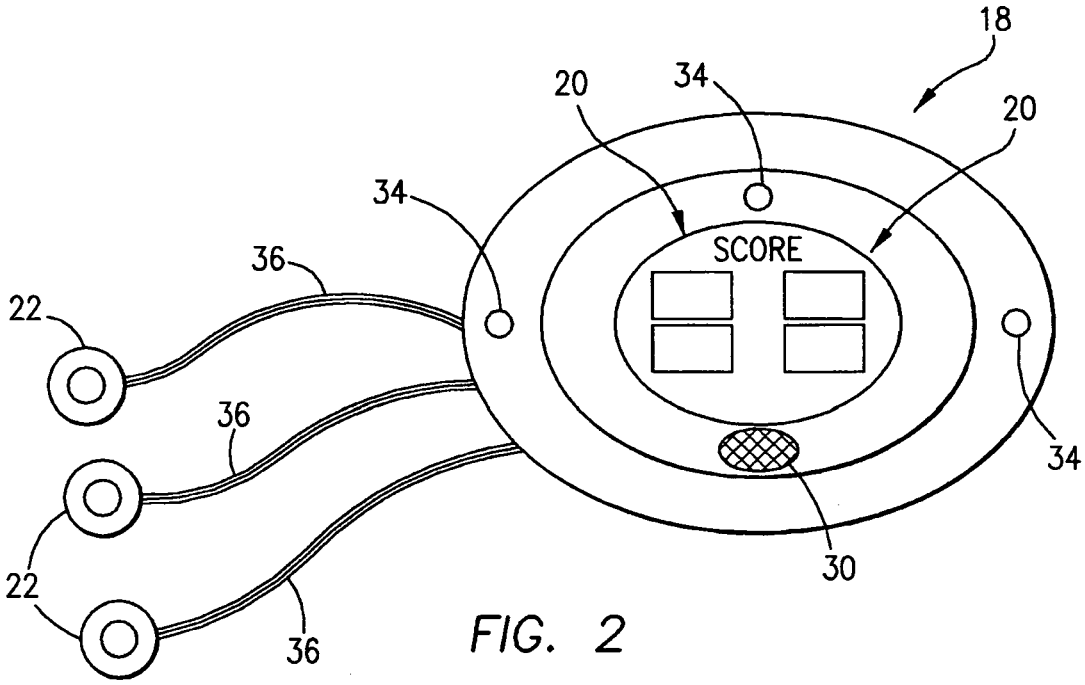
FIG. 2 is a front view of one embodiment of the housing, LCD display and force sensors shown in FIG. 1.
Figure 8:
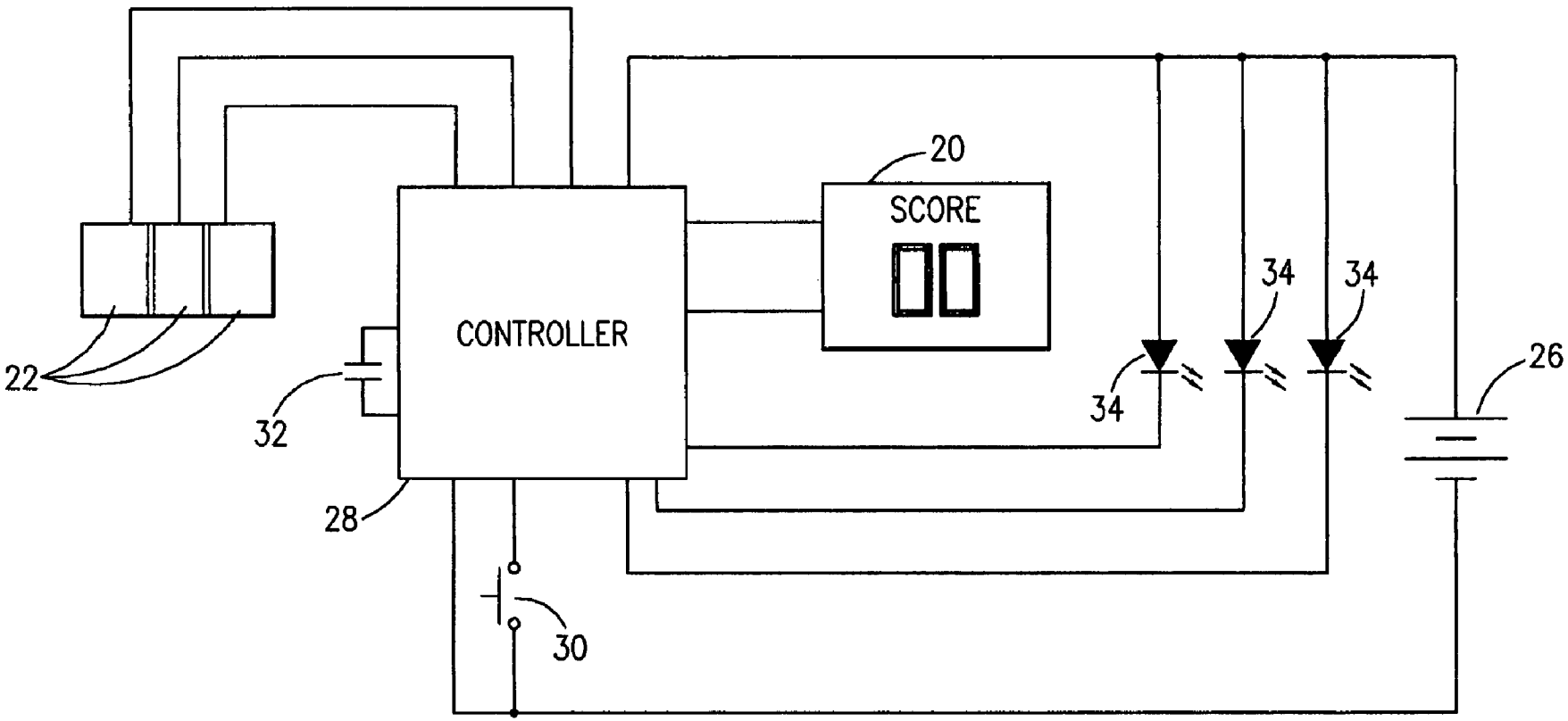
FIG. 8 is a schematic, block diagram of one embodiment of an electrical circuit employed in the shoe of this invention.

With reference to FIGS. 2 and 8, one embodiment of an electrical circuit 24 is depicted which is mounted within the housing 18 and coupled to the sensors 22. The electrical circuit 24 comprises a power source such as a battery 26, a controller 28, the LCD display 20, a manually operated switch 30, a capacitor 32, the pressure sensors 22 and one or more light emitting diodes (LEDs) 34. The controller 28 is preferably a commercially available integrated circuit which is coupled to the battery 26, LCD display 20 and LEDs 34 as shown in FIG. 8. As best seen in FIG. 2, wires 36 connect the controller 28 to the pressure sensors 22.

Figure 3:
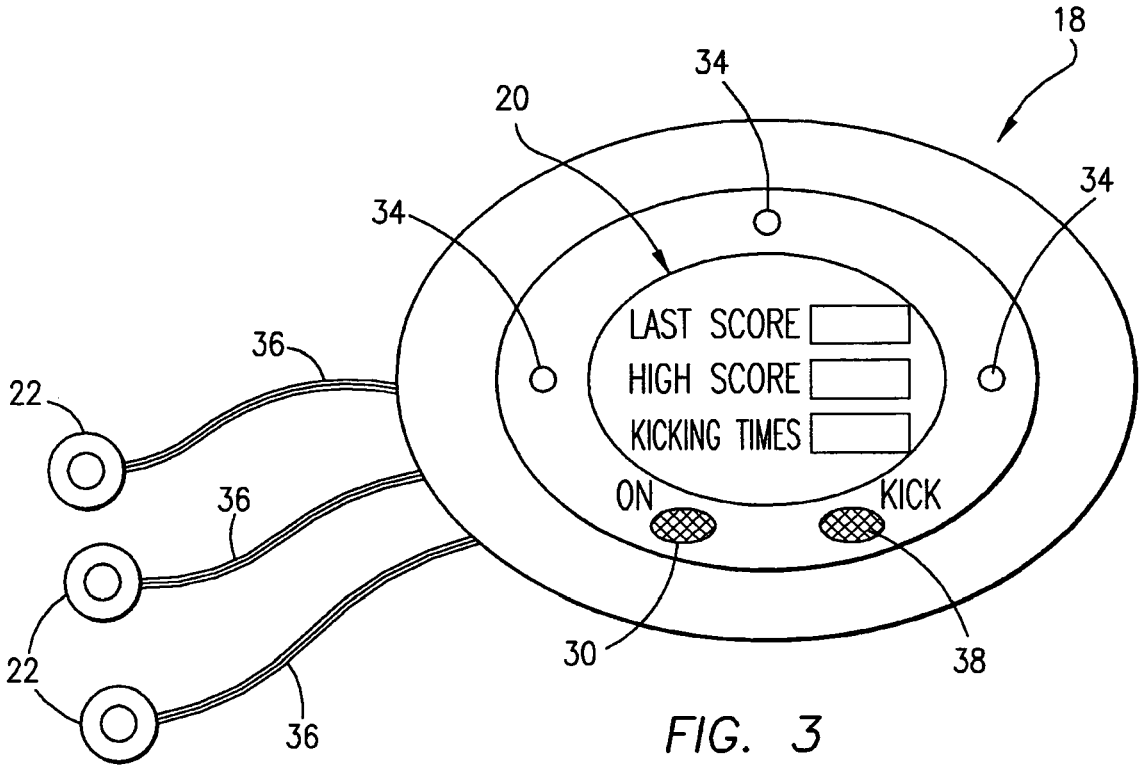
FIG. 3 is a view similar to FIG. 2 except of an alternative embodiment of the LCD display.

An alternative embodiment of that shown in FIGS. 2 and 8 is depicted in FIG. 3. The same reference numbers employed in a discussion of FIGS. 2 and 8 are used to identify the same structure in FIG. 3. This embodiment differs from that of FIGS. 2 and 8 primarily with respect to the information it displays, as discussed below. A second manual switch 38 is employed to cause the controller 28 to generate such information and display it on the LCD display 20.

Figure 4:
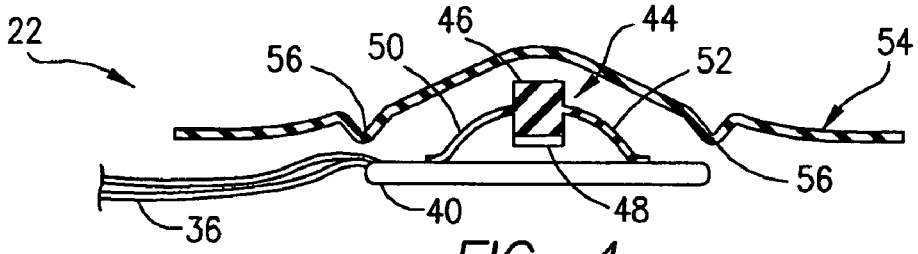
FIG. 4 is a side view in partial cross section of one embodiment of a force sensor according to this invention.
Figure 5:
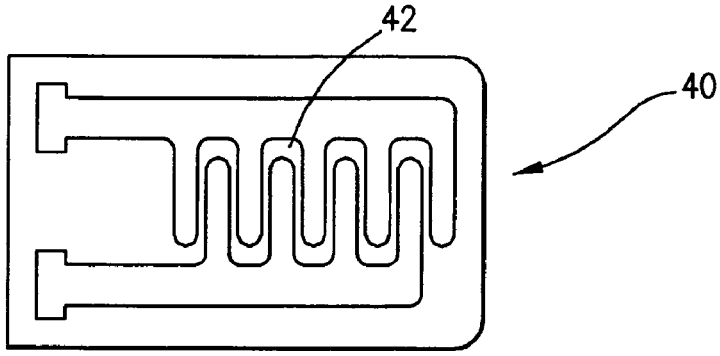
FIG. 5 is a plan view of a printed circuit employed in the sensor of FIG. 4.

Referring now to FIGS. 4-7, details of the pressure sensor 22 are shown. The pressure sensor 22 of FIGS. 4 and 5 comprises a printed circuit board ("PCB") 40 forming the base of the sensor having circuitry 42 which faces a contact 44. The contact 44 includes a rubber pad 46 mounted to a metal plate 48 which is held in position immediately above the PCB 40 by a pair of spring legs 50 and 52. A cover layer 54, preferably formed of rubber or similar material, overlies the contact 44 and PCB 40 as shown. One or more notches 56 may be formed in the cover layer 54 to enhance its sensitivity to the application of a force thereto, as discussed in more detail below. The PCB 40 is connected to the controller 28 by wires 36 as schematically shown in FIG. 4.

Figure 6:
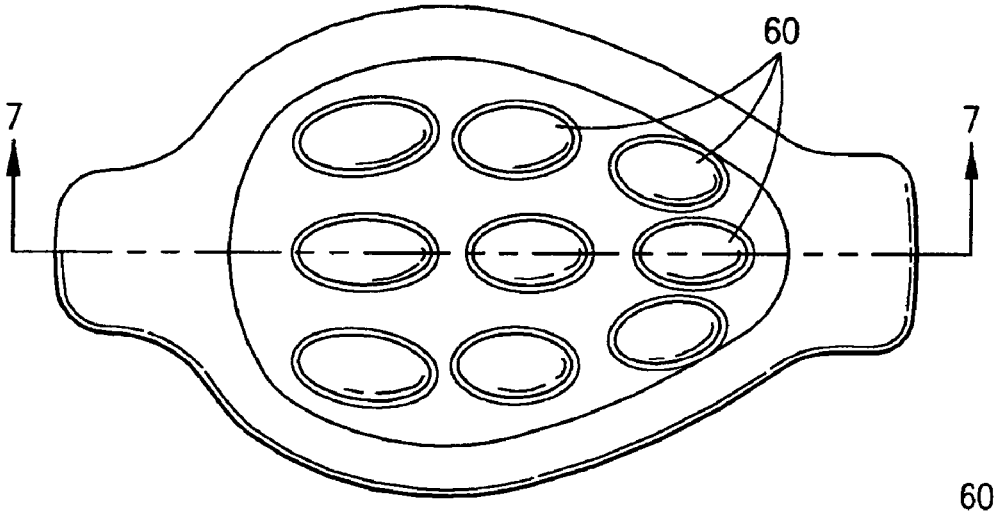
FIG. 6 is a plan view of an array of force sensors.
Figure 7:
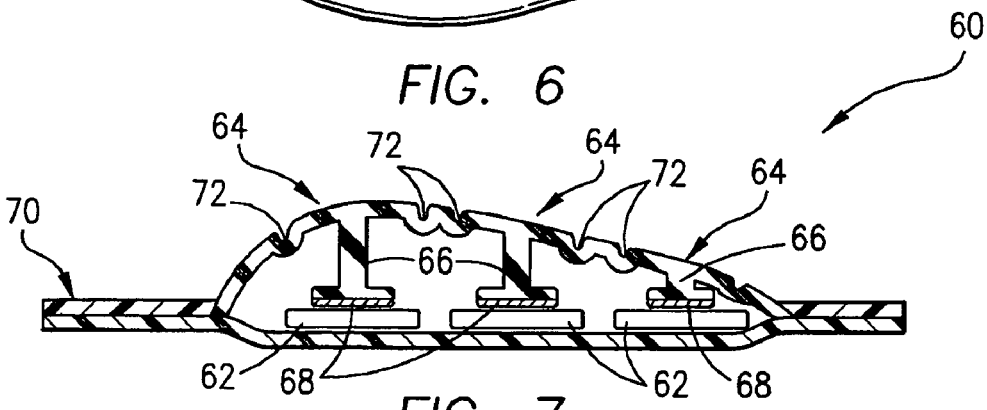
FIG. 7 is a cross sectional view taken generally along line 7-7 of FIG. 6 depicting the structure of an alternative embodiment of the force sensors of this invention.

An array of sensors 60 are shown in FIGS. 6 and 7 which may be arranged at essentially any desired location on the upper 14 of the shoe 10. In the presently preferred embodiment, each sensor 60 of the array comprises a PCB 62 mounted to the upper 14 immediately beneath a contact 64 consisting of an inverted T-shaped rubber pad 66 having a metal plate 68 at its lower end. The rubber pads 66 are connected at their upper end to or integrally formed in a cover layer 70 made of rubber or other resilient material having notches 72 similar to the notches 56 in the cover layer 54.

Operation of Shoe

Referring initially to the embodiment of FIGS. 2 and 8, the operation of the shoe 10 of this invention is as follows. Preferably, the sensors 22 or 60 are located on the upper 14 of the shoe 10 in one or more locations where it is desired that the foot of the wearer strike a soccer ball when one is kicking, particularly if the shoe 10 is to be used as a training aid. Alternatively, and especially for younger children, the sensors 22 or 60 are located in one or more areas of the shoe 10 most likely to strike a ball when kicked.

The present invention is intended to provide a numeric, or other visual indication, of the force with which the wearer of the shoe 10 strikes a ball. This is accomplished by first producing a signal representative of the magnitude of the force applied to the ball by the shoe 10, and then providing a visual indication corresponding to such force.

The pressure sensors 22 or 60 provide the signal. In response to contact with a ball as a result of a kick, the cover layer 54 of the pressure sensor 22, for example, deflects in a direction toward the upper 14 of the shoe 10. This deflection causes the contact 44 to move into engagement with the PCB 40 such that the metal plate 48 of the contact 42 engages the circuitry 42 of the PCB 40. The PCB 40 is operative to produce a "timing" signal representative of the duration or amount of time the metal plate 48 of contact 44 remains in engagement with the PCB circuitry 42 after a ball strike. The greater the amount of force applied to the cover layer 54 by a ball strike, and, hence, the contact 44, the greater the amount of time the metal plate 48 of the contact 44 remains in engagement with the PCB 40. The timing signal produced by the PCB 40 is sent to the controller 28 which is operative to cause the LCD display 20 to provide a visual representation, preferably numeric but not necessarily so, corresponding to the magnitude of the force with which the wearer of the shoe 10 kicked the ball.

The sensor 60 shown in FIG. 7 operates in essentially the same fashion as sensor 22. However, by employing an array of sensors 60 in proximity to one another, a more accurate indication of the force of a ball strike may be obtained than using sensors 22 spaced from on another. For example, if the location where the user kicked the ball is not directly aligned with an individual force sensor 22, its cover layer 54 and contact 44 may not be deflected and remain in engagement with the PCB 40 for a time period truly representative of the magnitude of force of the kick. The additional sensors 60 arranged in an array such as shown in FIGS. 6 and 7 help avoid this result by providing a larger area where sensors are present on the shoe upper 14. Further, each individual sensor 60 in the array produces a signal, such as described above, which is sent to the controller 28. Preferably, the controller 28 is programmed to detect the signal of longest duration for each ball strike, and cause the LCD display 20 to indicate the value corresponding to such signal thereby providing a more accurate reflection of the magnitude of force with which the ball was kicked.

Both the sensors 22 and 60 are provided with notches 56 and 72, respectively, in their cover layer 54 and 70. Since the cover layers 54 and 70 deflect in response to contact with a ball, and the duration of such deflection is employed to determine the force of a ball strike as noted above, it is important for the cover layers 54 and 70 to freely deflect on a consistent basis. The notches 56 and 72 increase the sensitivity of the respective cover layers 54 and 70 to the application of a force and promote consistent deflection toward and away from the PCBs 40 and 60.

In the embodiment of FIGS. 2 and 8, the electrical circuit 24 is turned on by depressing switch 30. When the circuit 24 is powered up, the LCD display 20 preferably displays a "0" and the LEDs 34 flash to denote the shoe 10 is ready to measure the force with which a ball is kicked. Assuming a sensor 22 is employed, for example, the timing signal produced by the PCB 40 as described above is sent to the controller 28. The controller 28, in turn, is operative to cause the LCD display 20 to provide a visual representation corresponding to the magnitude of the force with which the wearer of the shoe 10 kicked the ball. If an array of sensors 60 is used, each individual sensor 60 in the array produces a signal, such as described above, which is sent to the controller 28. Preferably, the controller 28 is programmed to detect the signal of longest duration from the individual sensors 60 for each ball strike, and cause the LCD display 20 to indicate the value corresponding to such signal. This provides a more accurate reflection of the magnitude of force with which the ball was kicked.

Referring now to the embodiment shown in FIG. 3, the controller 28 may be programmed to provide information in addition to the magnitude of force of a given ball strike. The electrical circuit 24 is turned on with the manual switch 30 as noted above, but the second switch 38 can be activated to obtain information in addition to the magnitude of a given ball strike. For example, as depicted schematically in FIG. 3, the "Last Score" section of the LCD display 20 is provided to display the magnitude of the force of the last ball strike. In addition to that value, a "high score" section is provided on the LCD display 20. The controller 28 is programmed to store in memory the value of the previous hardest ball strike for the wearer of the shoe 10. Each subsequent ball strike is compared by the controller 28 to the previous highest strike, and if a new ball strike exceeds the previous maximum then the new "high score" is displayed on the LCD display 20. Additionally, the controller 28 is operative to record the number of ball strikes in a given session of use of the shoe 10, e.g. between the time the switch 30 is turned on and then off. This number is displayed in the section identified as "Kicking Times" on the LCD display 20, in response to depressing the switch 38. The electrical circuit 24 is turned off by depressing both switches 30 and 38 at the same time for a few seconds.

It is also contemplated that the controller 28 programmed as described above in connection with a discussion of FIG. 3 could be used with the embodiment of FIG. 2. Instead of providing discrete, named sections on the LCD display 28 as in FIG. 3, the display 20 may be blank initially and responsive to signals from the controller 28 to provide alpha-numeric messages representative, for example, of the last ball strike, the hardest ball strike and a new ball strike. For example, after the electrical circuit 24 is turned on by depressing switch 30 the last ball strike may be displayed with an indication such as "Last Hit" and a numeric value of the magnitude of such ball strike. Depressing the switch 30 a second time may result in illumination of the LEDs 34 in a flashing sequence, and the display of the hardest hit recorded by the controller 28 thus far, e.g. "Hardest Hit" plus a numeric value. As described above, the controller 28 may be operative to store in memory the ball strike of highest magnitude, compare that value to each new ball strike and then display a new amount for the "Hardest Hit" if a new ball strike is of a magnitude greater than the previous hardest ball strike. A third depression of the switch 30 may result in another flashing sequence of the LEDs 34, followed by a representation of a new ball strike after a ball is kicked. This new kick may be indicated on the LCD display 20 as a "New Hit" accompanied by a number corresponding to the magnitude of such new ball strike.

While the invention has been described with reference to a preferred embodiment, it should be understood by those skilled in the art that various changes may be made and equivalents substituted for elements thereof without departing from the scope of the invention. In addition, many modifications may be made to adapt a particular situation or material to the teachings of the invention without departing from the essential scope thereof.

For example, in one presently preferred embodiment the visual indication of the magnitude of the force of a ball strike may be numeric. It is contemplated that other visual indications, or combinations thereof, could be employed such as alpha-numeric, graphical and the like.

Therefore, it is intended that the invention not be limited to the particular embodiment disclosed as the best mode contemplated for carrying out this invention, but that the invention will include all embodiments falling within the scope of the appended claims.

I claim:

1. An article of footwear, comprising:

an upper connected to an outsole;

a controller mounted to one of said outsole and said upper, said controller including a display;

at least one sensor coupled to said controller and being mounted to one of said outsole and said upper, said at least one sensor including a printed circuit board coupled to said controller and a contact movable into engagement with said printed circuit board upon impact with a ball, said at least one sensor being operative upon impact with the ball to transmit a signal to said controller representative of the magnitude of force with which said at least one sensor contacts the ball, said controller causing said display to provide a visual indication of the magnitude of said force.

2. The article of footwear of claim 1 in which said signal representative of the magnitude of force is a timing signal, the duration of said timing signal being dependent on the length of time said contact remains in engagement with said printed circuit board.

3. The article of footwear of claim 2 in which said at least one resilient mount is two spring legs mounted to said pad.

4. The article of footwear of claim 1 in which said contact comprises a pad, a metal plate connected to said pad and at least one resilient mount connected to said pad, said at least one resilient mount maintaining said pad and said metal plate in a spaced position relative to said printed circuit board until impact with a ball at which time said metal plate contacts said printed circuit board, said at least one resilient mount returning said pad and said metal plate to said spaced position when impact with the ball is terminated.

5. The article of footwear of claim 1 further including a cover layer overlying said contact.

6. The article of footwear of claim 5 in which said cover layer is formed with at least one notch.

7. The article of footwear of claim 1 in which said at least one sensor comprises an array of contacts each connected to a cover layer, each of said contacts including a pad having a first end joined to said cover layer and a second end which mounts a metal plate, said cover layer being movable in response to a ball strike between a first position in which said contacts are spaced from said printed circuit board and a second position in which said metal plate of said contacts engages said printed circuit board.

8. The article of footwear of claim 7 in which said cover layer is formed with at least one notch.

9. The article of footwear of claim 1 in which said controller stores in memory the highest force value resulting from contact between said at least one sensor and a ball, said controller being effective to compare said stored highest force value to each of said signals transmitted to said controller from said at least one sensor and to cause said display to provide a numeric indication in the event said stored highest force value is exceeded.

10. The article of footwear of claim 1 in which said controller is effective to record the number of signals transmitted by said at least one sensor and cause said display to provide a numeric indication representative of the number of times said at least one sensor contacts the ball.

11. The article of footwear of claim 1 further including a number of light sources coupled to said controller, said controller being effective to illuminate said light sources in a flashing sequence.

12. An article of footwear, comprising:

an upper connected to an outsole;

a controller mounted to one of said outsole and said upper, said controller including a display;

at least one sensor coupled to said controller and being mounted to one of said outsole and said upper, said at least one sensor including an array of contacts each operative to cause a timing signal to be transmitted to said controller in response to engagement with a ball, each of said timing signals being representative of the magnitude of force with which respective contacts engage the ball, said controller being effective to detect said timing signal of longest duration and to cause said display to provide a visual indication of the magnitude of said force based on said timing signal of longest duration.

13. The article of footwear of claim 12 in which said at least one sensor further includes a printed circuit board and a cover layer connected to said array of contacts, each of said contacts including a pad having a first end joined to said cover layer and a second end which mounts a metal plate, said cover layer being movable in response to a ball strike between a first position in which said contacts are spaced from said printed circuit board and a second position in which said metal plate of said contacts engages said printed circuit board.

* * * * *